United States Patent [19]

Simms et al.

[11] 4,094,563

[45] June 13, 1978

[54] METHOD OF FABRICATING AN ELECTRON TUBE

[75] Inventors: Robert A. Simms, Horseheads; Gene R. Feaster, Elmira, both of N.Y.

[73] Assignee: Westinghouse Electric Corp., Pittsburgh, Pa.

[21] Appl. No.: 660,875

[22] Filed: Aug. 9, 1967

[51] Int. Cl.[2] ..... H01J 9/18

[52] U.S. Cl. ..... 316/19; 316/24

[58] Field of Search ..... 316/18, 19, 20

[56] References Cited

U.S. PATENT DOCUMENTS

| | | | |
|---|---|---|---|
| 2,154,368 | 4/1939 | Tuuk et al. | 316/19 |
| 3,095,251 | 6/1963 | Slark | 316/19 |

*Primary Examiner*—Verlin R. Pendegrass
*Attorney, Agent, or Firm*—W. G. Sutcliff

[57] ABSTRACT

This invention relates to a method of fabricating and assembling the electrodes of an electron discharge device and includes in one illustrative embodiment the steps of processing within a first evacuated chamber an electrode such as a photocathode element, processing within a second evacuated chamber another portion(s) or electrode(s) of the device, assembling the first and second chambers together, evacuating the space therebetween, and assembling the photocathode element with another portion of the device. This assembling process is dependent upon providing an appropriate vacuum tight seal for both the first and second chambers which will withstand the processing temperatures and the vacuum established within the chambers, and which may be easily penetrated to bring the photocathode element and the portion of the electron discharge device together. In one illustrative embodiment, the other portion of the electron discharge device is placed upon a platform having a suitable cutting edge which is pressed upward through the seals associated with the second and first chambers to engage the photocathode element in the first chamber.

6 Claims, 4 Drawing Figures

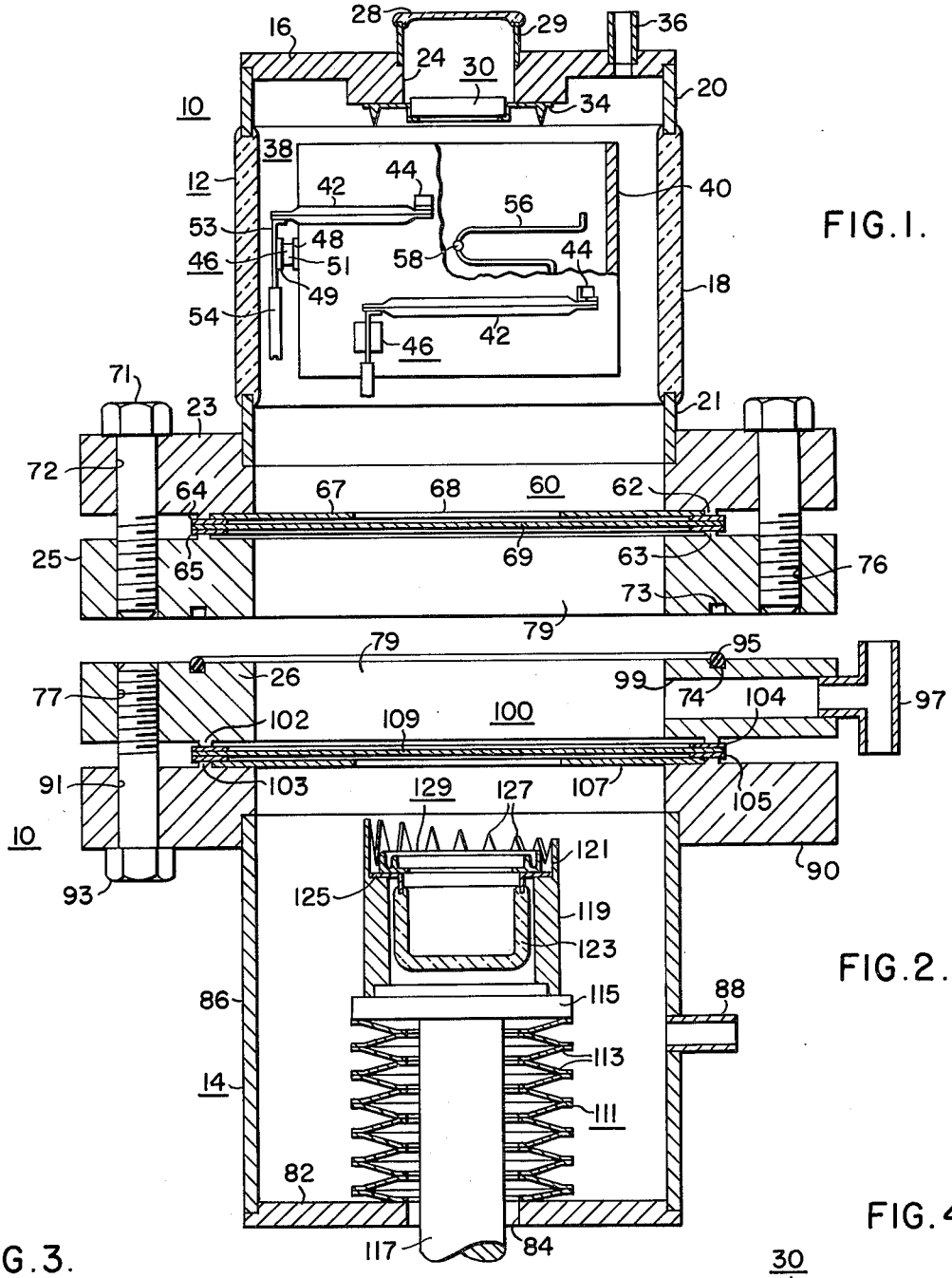
FIG. 1.
FIG. 2.
FIG. 3.
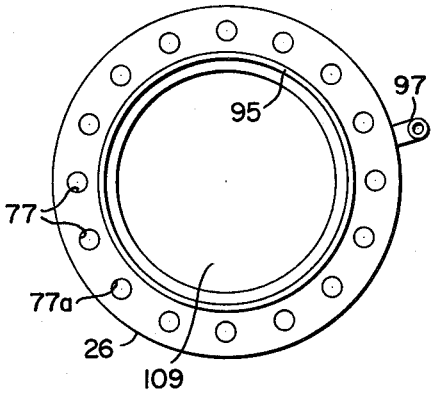
FIG. 4.
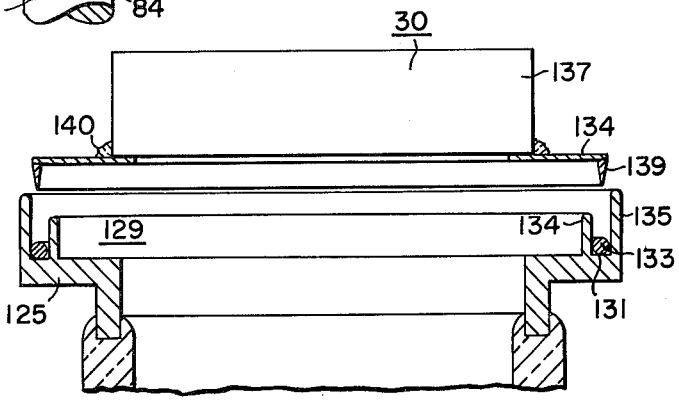

METHOD OF FABRICATING AN ELECTRON TUBE

BACKGROUND OF THE INVENTION

1. Field of the Invention

This invention relates to a method of processing and assembling an electrode within an electron discharge device and more particularly to the method of fabricating a photocathode element to be disposed within an electron image device.

2. Description of the Prior Art

Electrodes such as photocathode elements are employed in a wide variety of electron discharge devices including television camera pickup tubes and image intensifier tubes. A photocathode element serves to convert an incident radiation or optical image into a corresponding image of electrons. A photocathode element may be disposed within an orthicon type of television camera pickup tube for the purpose of generating an electron image corresponding to the incident radiation image. The electron image is focused upon a storage target which develops a pattern of charges corresponding to the incident electron image and the radiation image. An electron gun is provided to scan the storage target with a low velocity beam of electrons. A portion of the electrons directed upon the storage target is returned to an electron multiplier including a plurality of dynode elements which repeatedly multiplies the return beam of electrons to provide an output signal.

In the fabrication of an electron discharge device as described above, the envelope of this device is evacuated and baked at a temperature in the range of 400° C to remove the occluded gases from the envelope. The various metallic electrodes are inserted within the envelope and are then heated and degassed. Next, the thermionic cathode is activated. After this normal processing of the device, the photocathode element is then deposited upon a transparent faceplate of the envelope. Illustratively, a layer of a suitable electrically conductive material such as an alloy of silver and/or antimony is first deposited upon the envelope. Next, a suitable alkali is generated to sensitize the layer of electrically conductive material. Alkali materials such as cesium, sodium and potassium are typical sensitizing materials.

The fabrication of photocathode elements is a very difficult process even when the environment of the processing is accurately controlled. The environment of formation includes many aspects including the geometry of the electrodes and the envelope of the device, the nature of the transparent substrate upon which the photocathode element is deposited, the cleanliness of the electrodes and the envelope, and the thermal cycling with which the photocathode element is deposited. When the photocathode element is of a more complex type such as the tri-alkali S-20 variety, the control of the formation process becomes even more demanding if high performance photocathode elements are to be realized. It is estimated for complex photocathode elements such as the S-20 variety, that the percentage of successfully completed photocathode elements is in the order of 30% of the attempted photocathode elements. Even after the control procedures and the limits have been established for the particular environment of a certain electron tube, it is often necessary to change significantly the procedure when it is desired to deposit a photocathode element in the new environment of another electron discharge device. Again a rigorous trial and error procedure must be incurred before control of the photocathode formation process is again obtained in the new environment.

It is therefore, an object of this invention to provide a new and improved method of fabricating an electrode or more specifically a photocathode element for an electron discharge device whereby the steps of fabrication and assembling may be more accurately controlled and may be more quickly standardized for many types of electron discharge devices.

It is a further object of this invention to provide a new and improved method of fabricating and encapsulating an electrode and more specifically a photocathode element whereby the electrode may be fabricated at a point in time and stored to be incorporated into an electron discharge device at a latter time.

SUMMARY OF THE INVENTION

Briefly, the present invention accomplishes the above cited objects by providing an improved method of fabricating an electrode or more specifically a photocathode element for an electron discharge device including the steps of processing the electrode within a first evacuated chamber, processing another portion of the electron discharge device within a second evacuated chamber, assembling the first and second evacuated chambers, evacuating the intermediate space between the first and second chambers to the desired condition, and assembling the electrode with the other portion of the electron discharge device. The first and second chambers in which the electrode and the other portion of the electron discharge device are fabricated both include sealing members which will withstand the processing condition of the electron discharge device including the pressure differential created by the high vacuum within envelope of the device. Further, the members should be penetrable by a suitable instrument so that the electrode and the other portion of the electron discharge device may be joined.

BRIEF DESCRIPTION OF THE DRAWINGS

These and other objects and advantages of the present invention will become more apparent in view of the following detailed description and drawings, in which:

FIGS. 1 and 2 show sectioned views of the first and second evacuated chambers in which the photocathode element and the other portion of the electron discharge device respectively are fabricated in accordance with the teachings of this invention;

FIG. 3 is a plan view of the second chamber as shown in FIG. 2; and

FIG. 4 is a sectioned view of an illustrative seal between the photocathode element and the remaining portion of the electron discharge device.

DESCRIPTION OF THE PREFERRED EMBODIMENT

Referring now to the drawings, there is shown a processing chamber 10 including an upper envelope or chamber portion 12 as shown in FIG. 1 and a lower envelope or chamber portion 14 as shown in FIG. 2. In particular, the upper envelope portion 12, in which a photocathode assembly 30 is formed, includes an end plate 16 to which is secured in a vacuum tight relation a cylindrical member 18 made of a suitable insulating material such as glass by an interconnecting member 20 of cylindrical configuration. The other end of the cylindrical member 18 is connected to a sealing flange 23 in a vacuum tight relation by an interconnecting member 21. The interconnecting members 20 and 21 may be made of a metallic material suitable for bonding with the insulating material of the member 18 such as Kovar (a trademark of the Westinghouse Electric Corporation for an alloy of iron, nickel and cobalt). The members 20 and 21 may be respectively heliarc welded to the end plate 16 and to the sealing flange 23.

A transparent window 28 is disposed centrally of the axis of the envelope portion 12. The window 28 may be made of a suitable radiation transmissive material such as glass and is supported upon a cylindrical spacing member 29 which may be made of a suitable material such as Kovar. The spacing member 29 may be secured by heliarc welding in a vacuum tight relation to the end plate 16. An aperture 24 is formed within the end plate 16 about the axis of the envelope portion 12 to allow radiation directed through the transparent window 28 to fall upon the photocathode assembly 30. The photocathode assembly 30 is supported upon the end plate 16 by a flange 34. Further, a pumping port 36 is connected to the end plate 16 to allow the upper envelope portion 12 to be evacuated.

The opposite end of the upper envelope portion 12 is enclosed by a seal 60. In particular, the seal 60 includes a member 69 disposed across the opening into the upper envelope portion 12 and made of a material capable of withstanding the processing required to fabricate the photocathode element and the vacuum conditions established within the upper envelope portion 12. More specifically, the member 69 must have the properties of: the ability to withstand an atmospheric pressure differential between an ambient pressure on the exterior of the envelope portion 12 and a vacuum of approximately $10^{-9}$ torr or between within the upper envelope portion 12; the ability to provide a vacuum seal compatible with vacuums of $10^{-9}$ torr or better; sufficient strength and oxidation resistance to remain structurally strong and leak free under normal bake out and the process thermal cycles of the photocathode element, which may require withstanding temperatures in the order of 350° C; compatibility with the processing of the photocathode element; and the capability of being easily penetrated or pierced by a simple cutting edge. In actual practice, layers of a metallic material such as aluminum and nickel having a thickness in the range of 1½ to 3 mils have met the above enumerated conditions.

The penetrable member 69 is vacuum sealed to the sealing flange 23 by a pair of gaskets 64 and 65 which are disposed on either side of the member 69 and are pressed thereagainst by an annular member 25. Pressure is applied upon the annular member 25 to press the gaskets 64 and 65 upon the member 69 by suitable securing means such as a plurality of bolts 71. A plurality of openings 72 are disposed about the periphery of the sealing flange 23 to receive the bolts 71. The annular member 25 has a plurality of threaded openings 76 disposed about the aperture to receive and to fasten the bolts 71. As the bolts 71 are tightened, a pair of continuous feet or projections 62 and 63 of circular configuration press the gaskets 64 and 65 against the penetrable member 69 to thereby form a vacuum tight seal. Illustratively, the gaskets 64 and 65 may be made of a soft, permeable material such as aluminum in order to form the desired vacuum seal. In the instance, where the member 69 is made of aluminum, the gaskets 64 and 65 may be omitted. In order to support the pressure applied against the penetrable member 69 due to the difference in pressure between the inside and the outside of the envelope portion 12, a support ring 67 is disposed to abut against the support flange 23. The support ring 67 has an aperture 68 disposed centrally therein to allow the remaining portion of the electron discharge device to be inserted therethrough.

In order to form the photocathode element, a photocathode generator assembly 38 is disposed within the upper envelope portion 12, as shown in FIG. 1. The photocathode generator assembly 38 includes a support member 40 of cylindrical configuration and made of a suitable electrically conductive material such as stainless steel or nickel. A plurality of channels 42 are disposed upon the outer periphery of the support member 40. Illustratively, the channels 42 take the form of a tubularly shaped member having a loosely formed seam to allow the mixtures of materials deposited therein to evaporate through the seam and onto the photocathode assembly 30. The channels 42 are supported upon the member 40 by a tab 44 which is secured by spot welding to one end of the channel 42. The other end of the channel 42 is supported by an electrically conductive lead 53. Typically, the tab 44 may be secured to the periphery of the support member 40 by spot welding. The electrically conductive lead 53 is in turn supported in an insulating relationship with respect to the support member 40 by a spacer 46. The insulating spacer 46 includes a pair of elements 48 and 49 which are respectively connected to the support member 40 and to the terminal lead 53. A block or pedestal 51 of suitable insulating material such as aluminum oxide is disposed between and fused to the elements 48 and 49. Suitable insulating sleeves 54 are disposed about the leads 53. The leads 53 are taken out through the cylindrical member 18 of insulating material so that separate potentials may be applied to each of the channels 42. Various alkalies or combination of alkalies such as potassium, cesium and sodium may be disposed with appropriate vehicles within the channels 42 so that when a suitable potential is applied thereacross, a vapor of the appropriate alkali will be evaporated onto the photocathode assembly 30. In addition, a collapsible filament support 56 is disposed upon the interior surface of the support member 40. The filament 56 takes the form of a U-shaped member having one of its end portions secured to the support member 40 and the bight of the U-shaped member having a bead 58 of a suitable electrically conductive material such as a compound of silver and/or antimony deposited thereon. It is noted that the other end of the filament 56 is insulated from the attached end so that a suitable current may be passed therethrough to thermally excite the bead 58 to emit a metallic vapor onto the photocathode assembly 30.

Referring now to FIG. 2, the lower envelope or chamber portion 14 of the processing chamber 10 includes an end plate 82, and a cylindrical member 86 which is secured to the end plate 84 in a vacuum tight relationship as by heliarc welding. A sealing flange 90 of annular configuration is secured in a vacuum tight relationship to the other end of the cylindrical member 86. A pumping port 88 is provided through an aperture in the cylindrical member 86 to allow the envelope portion 14 to be evacuated. An aperture 84 is centrally disposed through the end plate 82 to allow an adjusting rod 117 to be moved up and down along the center axis of the envelope portion 12. A platform 115 is secured to one end of the adjusting rod 117 and serves to support a cylinder 119. In turn, the cylinder 119 supports the remaining portion of the electron discharge device which is to be assembled with the photocathode assembly 30 shown in FIG. 1. As shown in FIG. 2, the remaining portion of the electron discharge device includes an envelope 123 made of a suitable insulating material, and a seal support flange 125 which is fused to one end of the envelope 123. Though the internal electrode structure of the device is not shown in FIG. 2, it is understood that the device can take the form of a television camera pickup tube as described above or an image intensifier tube as described in U.S. Pat. No. 3,114,044 to Sternglass and assigned to the assignee of this invention. The seal support flange 125 is disposed upon a recess 121 within the support cylinder 119. As shown in FIG. 2, a plurality of cutting teeth 127 are disposed upon the support cylinder 119 to extend above a seal 129 secured to the flange 125. As will be explained later in detail, the plurality of sharpened teeth 127 are disposed in a plane askewed with respect to the axis of the lower envelope portion 14 to efficiently penetrate the seal 60 associated with the upper envelope portion 12 and a seal 100 associated with the lower envelope portion 14. If the teeth 127 were to contact the seals simultaneously, there might be a tendency to tear the seals at their edges where they are clamped. The evacuated condition within the lower envelope portion 14 is maintained by a bellows 111 which is secured to the end plate 82 and the platform 115. The bellows 111 insures a vacuum tight seal between the platform 115 and the end plate 82 and allows the platform 115 to be moved up and down along the axis of the envelope portion 14. In particular, the bellows 111 is made up of a plurality of flexible ring-shaped members 113 which have their inner and outer edges successively vacuum sealed to each other as by heliarc welding.

The lower envelope section 14 is enclosed at the other end by the seal 100. In particular, the seal 100 includes a penetrable member 109 which is sealed in a vacuum tight relationship to the sealing flange 90. A pair of gaskets 104 and 105 similar to that described above may be disposed upon either side of the penetrable member 109 and are pressed against the member 109 by an annular member 26. A ring 107 is disposed against the flange 90 to support the member 109 against the forces developed by the pressure differential between the inside and outside of the envelope portion 14. The annular member 26 is secured to the sealing flange 90 by appropriate securing means such as a plurality of bolts 93. The plurality of bolts 93 are disposed through a plurality of apertures 91 within the flange 90 to be received by a plurality of threaded apertures 77 disposed in the annular member 26. As the bolts 93 are screwed into the threaded apertures 77, a pair of circularly shaped feet or projections 102 and 103 are pressed against the gaskets 104 and 105 to thereby effect a vacuum tight seal between the penetrable member 109 and the support flange 90.

The lower envelope portion 14 may be secured to the upper envelope portion 12 by a plurality of bolts (not shown) similar to those designated by the numerals 71 and 91. Referring now to FIG. 3, it is evident that the alternate openings **77*a* disposed in the annular member 26 are not filled with the bolts 91 which secure the annular member 26 to the support flange 90. Instead, additional bolts are disposed through the openings 77*a* to secure the support flange 90 and the annular member 26 to the annular member 25 and the support flange 23. An effective vacuum tight seal is effected between the annular member 25 and the annular member 26 by an 0-ring or sealing member 95 which is disposed within a circularly shaped recess 74 of the annular member 26 and a circularly shaped recess 73 of the annular member 25. When the upper and lower envelope portions 14 and 16 have been joined as explained above, a third or intermediate chamber (or envelope) portion 79 is formed by the annular members 25 and 26 and the penetrable members 69 and 109. As shown in FIG. 2, the intermediate envelope portion 79 may be evacuated through a conduit 99 disposed in the annular member 26 and a pumping port 97**.

Referring now to FIG. 4, there is shown in detail the cold seal 129 which provides an effective mechanism for securing in a vacuum tight relationship the photocathode assembly 30 disposed in the upper envelope portion 12 and the remaining portion of electron discharge device which was processed in the lower envelope portion 14. The cold seal 129 includes a well 131 formed upon the seal support flange 125 and includes first and second walls 134 and 135 disposed concentrically about each other. A suitable malleable sealing substance 133, such as indium or copper is disposed continuously along the bottom of the well 131. The photocathode assembly 30 includes a transparent support plate 137 upon which there is deposited a photocathode element. Illustratively, the support plate 137 is made of a material transmissive to the radiation to be sensed such as a fiber optic assembly or a layer of glass or quartz. The support plate 137 is hermetically sealed to the flange 34 by a suitable substance such as a frit seal 140. A cylindrically shaped knife edge or dagger 139 is disposed along the periphery of the flange 34. The dagger 139 is of such a diameter to fit between the walls 134 and 135 to engage the sealing substance 133. It may be understood that an effective vacuum tight seal may be effected by merely pressing the dagger 139 into the substance 133.

In accordance with the teachings of this invention, an electron discharge device may be fabricated by forming an electrode such as a photocathode assembly 30 within the first envelope portion 12 and then processing separately the remaining portion of the electron discharge device within the lower envelope portion 14. Illustratively, a photocathode element may be formed within the upper envelope portion 12 by first securing the photocathode assembly 30 upon the end plate 16. The seal 60 is formed by placing the penetrable member 69 between the two gaskets 64 and 65 and securing the annular member 25 to the sealing flange 23 by inserting the plurality of bolts 71 into the threaded openings 76. Once the vacuum tight seal 60 has been formed, the upper envelope portion 12 is evacuated by a suitable pump through the port 36. The port 36 may be effectively sealed by crimping its sides. Illustratively, a vacuum in the order of $10^{-9}$ torr or greater may be formed within the envelope portion 12. Next, the photocathode assembly 30 may be baked to a temperature in the order of 350° C to degass the occluded gases that may be concealed therein. The photocathode element may be formed upon the support plate 137 by first depositing a layer of a suitable electrically conductive material. In one particular embodiment, the electrically conductive layer is formed by directing a current through the filament support 56 to thereby evaporate the bead 58 of antimony. Next, the electrically conductive layer is sensitized by the evaporation of appropriate alkalies. In one illustrative embodiment of this invention, the sensitizing agents could be a combination of cesium, sodium and potassium to form an S-20 photocathode element. More specifically, these alkalies may be generated by the channels 42. Appropriate potentials may be applied across the channels 42 from the terminal 53 to the support member 40 to thereby heat and to evaporate the appropriate alkali through the slits of the channels 42. The evaporated alkali will deposit upon the electrically conductive layer to thereby sensitize the conductive layer. In order to test the response of the photocathode element, a source of radiation of a suitable wavelength may be directed through the transparent window 28 to cause the photocathode element to emit electrons. A suitable electrical connection may be made to the support member 40 to thereby collect the electrons and to measure the intensity of electron emission.

A particular advantage of this invention resides in the capability of easily discarding a photocathode assembly which does not meet the required specifications without incurring the normal waste of the remaining part of the electron discharge device. It is a relatively simple and inexpensive matter to remove a defective photocathode assembly and to fabricate a new photocathode element. Though the process described above was described with respect to a specific photocathode element (i.e. S-20 type), other photocathode elements could be formed according to the methods as described in U.S. Pat. Nos. 2,682,479 and 2,914,690 without departing from the teachings of this invention. Further, this invention is not limited to the formation of photocathode elements but rather would have application to the fabrication of any difficult to process electrode.

At this stage of the fabrication of the electron discharge device, the upper envelope portion may be sealed off by pinching the pumping port 36 to form a self-contained unit having therein a photocathode element which may be mated to any number of types of electron discharge devices. It is an important aspect of this invention that the upper envelope may be stored for prolonged periods or be shipped to locations distant from the point of manufacture to be coupled with a suitable electron discharge device.

The next stage of fabrication involves the processing of the remaining portion of the electron discharge device within the lower envelope portion 16. The remaining portion of the electron discharge device which may include the envelope 123 and a seal support flange 125 is disposed upon the support cylinder 119 within the lower envelope portion 14. Next, the vacuum seal 100 is formed by disposing the gaskets 102 and 103 on either side of the penetrable member 109 and inserting the bolts 93 within the threaded aperture 77 to thereby press the feet 104 and 105 against the gaskets 102 and 103. It may be understood that the electron discharge device disposed within the envelope 123 may be a television camera pickup device including an appropriate storage target, an electron gun and a plurality of dynode elements or may take the form of an image intensifier as described in the above-identified patent to Sternglass. Next, the lower envelope portion 14 is evacuated by a suitable vacuum pump which is connected to the pumping port 88. The port 88 may effectively be sealed by crimping. The device is then baked at an elevated temperature to remove the occluded gases from the envelope and the electrodes. If the electron discharge device disposed within the envelope 123 includes a thermionic cathode element, the cathode element would be activated at this time.

In order to assemble the remaining portion of the electron discharge device and the photocathode assembly 30, it is first necessary to secure the upper envelope portion 12 with the lower envelope portion 14. This may be accomplished by inserting a plurality of bolts through the openings within the sealing flange 90 and the annular member 26 to be received by the threaded openings 76 of the annular member 25. An effective, vacuum tight seal is achieved between the annular members 25 and 26 by the 0-ring 95 as it is compressed into the recesses 73 and 74. When a seal is effected by the 0-ring 95 between the annular members 25 and 26, the intermediate chamber 79 is established between the penetrable members 69 and 109. Next, the intermediate envelope portion 79 is evacuated by applying a suitable vacuum pump to the pumping port 97. The intermediate envelope portion 79 is evacuated to a pressure to match that established within the envelope portions 14 and 16.

One of the advantages of this invention is that different environments may be established for the processing of the various electrodes. For example, an inert atmosphere may be established within one envelope portion to allow a sputtering or evaporation process to be carried out. In the example described above, a photocathode element may be formed in a vacuum of approximately $10^{-8}$ to $^{-9}$ torr. For the particular example of the photocathode fabrication, the intermediate envelope portion 79 should be pumped to a sufficiently low total pressure to insure a sufficiently low partial pressure of those gaseous components that are inimical to the formation of a photocathode element. In general, the pressure of the environment within the intermediate portion 79 must match the pressures in the upper and lower envelope portions 12 and 14 to a sufficient degree to prevent any explosive or rupturing action during or before penetration by the plurality of teeth 127. Further, the atmosphere within the intermediate envelope portion 79 must not contain appreciable amounts of gases harmful to the electrode fabricated within the envelope portion 12. Subject to the above qualifications, the pressure established within the intermediate envelope portion 79 does not have to be precisely equal to that established with the upper and lower envelope portions 12 and 14; for example, at low vacuums, a pressure of $10^{-12}$ torr may be established within the intermediate envelope portion 79, while envelope portions 12 and 14 could be at pressures in the order of $10^{-6}$ torr.

In order to connect the remaining portion of electron discharge device with the photocathode assembly 30, the adjusting rod 117 is directed upward along the axis of the processing chamber 10 either manually or by a hydraulic press. As the adjusting rod 117 is pushed upward, the cutting teeth 127 successfully pierce or cut the penetrable members 109 and 69. As the penetrable members 109 and 69 are cut, they tend to peel back and do not interfere with the further movement of the rod 117. Next, the support cylinder 119 is directed into the upper envelope portion 12 and the dagger 139 associated with the photocathode assembly 30 is inserted into the well 131 to engage the malleable sealing substance 133. Typically, the substance 133 may be indium which is malleable at normal room temperatures and effects a vacuum tight seal with the dagger 139. At this point, the bolts securing the upper and lower envelope portions 12 and 14 may be withdrawn and the completed electron discharge device exposed to normal atmospheric conditions. The finished electron discharge device is now substantially complete and ready for further testing.

The above described process has many advantages over the methods of fabrication used by the prior art. By forming the photocathode element within a separate envelope portion, the photocathode element may be processed under conditions optimum for the formation of the photocathode element. On the other hand, the remaining portion of the electron discharge device may be processed under substantially different and optimal conditions. Further, the contaminants which are generated within the upper envelope portion during the fabrication of the photocathode element will not be deposited upon the other electrodes of the electron discharge device as presently occurs in the normal processing methods of the prior art. Further, such electrodes which are expensive to fabricate, as photocathode elements, may now be manufactured and marketed as individual items. As a result, many organizations such as university laboratories which have the capability of manufacturing electron discharge devices but are unable to perfect the processing of a reliable and precise photocathode element will be able to purchase photocathode elements of almost any type and assemble them with the remaining portion of the electron discharge device. Further, since the environment in which the photocathode element is fabricated may now be standardized, more precise control over the variables affecting cathode processing can be maintained. As a result, the quality of the resultant photocathode element is substantially improved and the number of rejected photocathode elements which do not meet the required specifications is reduced. Additional savings in terms of labor and materials are realized because the photocathode elements may be mass produced at a time and rate that is most economical or useful to the manufacturer.

Since numerous changes may be made in the above described apparatus and different embodiments of the invention may be made without departing from the spirit thereof, it is intended that all matter contained in the foregoing description or shown in the accompanying drawings shall be interpreted as illustrative and not in a limiting sense.

We claim as our invention:

1. A method of fabricating an electron discharge device including the steps of providing a first chamber portion having a first penetrable portion disposed between the interior and exterior thereof, forming an electrode within said first chamber portion, providing a second chamber portion having a second penetrable portion disposed between the interior and exterior thereof, forming a portion of said electron discharge device to be associated with said electrode, connecting said first and second chamber portions to form a third chamber portion therebetween, penetrating said first and second penetrable members and moving said electrode and said portion of said electron discharge device together so that said portion of said electron discharge device and said electrode may be assembled to form an evacuated electron discharge device with said first and second penetrable portion exterior of said electron discharge device.

2. A method of fabricating an electron discharge device including the steps of providing a first chamber portion having a first penetrable portion disposed between the interior and exterior thereof, processing an electrode for said electron discharge device within said first chamber portion and establishing a first environment within said first chamber portion, providing a second chamber portion having a second penetrable portion disposed between the interior and exterior thereof, forming a portion of said electron discharge device within said second chamber portion and establishing a second environment within said second chamber portion, coupling said first and second chamber portions to form a third chamber portion therebetween, establishing a third environment within said third chamber portion, and removing at least a portion of said first and second penetrable portions so that said portion of said electron discharge device and said electrode may be assembled together to form an evacuated electron discharge device with said first and second penetrable portions exterior of said electron discharge device.

3. A method of fabricating an electron discharge device as claimed in claim 2, wherein the pressure of said third environment is matched to the pressure of said first and second environments to such a degree so as to prevent the rupture of said first and second penetrable portions.

4. A method of fabricating an electron discharge device as claimed in claim 2, wherein said portion of said electron discharge device is sealed to said electrode so as to form a vacuum tight envelope therewith.

5. A method of fabricating an electron discharge device as claimed in claim 2, wherein said electrode is a photocathode element and the step of forming said electrode includes the steps of depositing a layer of electrically conductive material and sensitizing said layer of electrically conductive material.

6. A method of forming an electron discharge device as claimed in claim 2, wherein said first chamber portion is stored for a period of time after the establishment of said vacuum condition therein.

* * * * *